United States Patent [19]

Weihrich et al.

[11] Patent Number: 4,685,063

[45] Date of Patent: Aug. 4, 1987

[54] PROCESS AND DEVICE FOR COMPENSATION OF THE EFFECT OF ROLL ECCENTRICITIES

[75] Inventors: Georg Weihrich, Uttenreuth; Dietrich Wohld, Erlangen, both of Fed. Rep. of Germany

[73] Assignee: Siemens Aktiengesellschaft, Berlin and Munich, Fed. Rep. of Germany

[21] Appl. No.: 752,407

[22] Filed: Jul. 5, 1985

[30] Foreign Application Priority Data

Jul. 5, 1984 [DE] Fed. Rep. of Germany ..... 3424693

[51] Int. Cl.[4] ..... G06F 15/46; B21B 37/12

[52] U.S. Cl. ..... 364/472; 72/16; 72/21

[58] Field of Search ..... 364/472, 469, 149–151, 364/176; 72/6, 8–12, 21

[56] References Cited

U.S. PATENT DOCUMENTS 3,881,335 5/1975 Cook ..... 72/21 X
3,882,705 5/1975 Fox ..... 72/21 X
3,928,994 12/1975 Ichiryu et al. ..... 72/21 X
4,126,027 11/1978 Smith, Jr. et al. ..... 364/472 X
4,485,497 12/1984 Miura ..... 364/472 X
4,521,859 6/1985 Fapiano ..... 364/472
4,531,392 7/1985 Puda ..... 72/19 X
4,580,224 4/1986 Gerber ..... 364/472

*Primary Examiner*—Joseph Ruggiero
*Attorney, Agent, or Firm*—Mark H. Jay

[57] ABSTRACT

A process and device for compensation of the effect of roll eccentricities upon thickness regulation of material being rolled in a roll stand (1), wherein eccentricity oscillations are simulated by a model (6) based on measured values of roll adjustment position (s), roll force ($F_W$) and mean support roll speed (n), together with spring constants ($C_G$, $C_M$) for the roll stand and the material. An output signal ($\Delta_R$) of the model (6) is used to modify the thickness value ($h_a+\Delta R$) used for regulation, so as to compensate for the effect of roll eccentricity. The model may be implemented by a device (RECO) comprising pairs of oscillators (7), the phase and amplitude relationships of which are adjusted according to the observer principle.

7 Claims, 5 Drawing Figures

RECO

PROCESS AND DEVICE FOR COMPENSATION OF THE EFFECT OF ROLL ECCENTRICITIES

Figure 1:
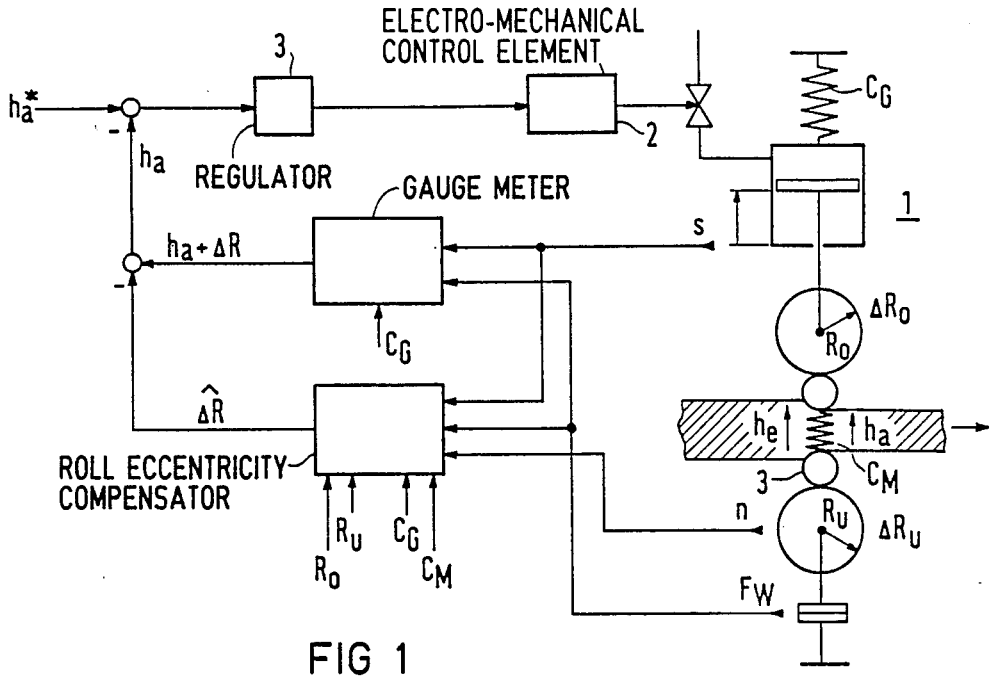

The invention relates to a process and a device for compensation of the effect of roll eccentricities in position- or thickness regulation of roll stands.

According to U.S. Pat. No. 3,928,994 it is known to eliminate, by a method of autocorrelation, the effect of roll (roller or cylinder) eccentricities on a signal used for an actual value of stand elasticity. Another component of the indirectly formed actual value signal, namely roll (positional) adjustment, is not affected by this, so that with this known process, compensation of the effect of roll eccentricities is only partially achieved. Furthermore, because of the mean value formations used therein, autocorrelation methods always entail a time expenditure which limits the speed of response of thickness regulation.

According to the present invention there is provided a process for compensation of the effect of roll eccentricities in position or thickness regulation of a roll stand, comprising steps of:

(a) forming a sum signal from a measured value of a roll force multiplied by the sum of the inverse values of a stand spring constant and a material spring constant, and a measured value of a roll adjustment position;

(b) sending the sum signal through a high pass filter a frequency of which is adjusted in dependence upon a speed of a support roll of the roll stand;

(c) comparing an output signal of the high pass filter with a sum output signal of at least one pair of oscillators, said oscillators being provided for simulation of roll eccentricity oscillations, and frequencies of said oscillations being preset in dependence upon the radius of the support roll and being adjusted in dependence upon the support roll speed;

(d) adjusting the oscillators in respect of amplitude and phase relationship so that a deviation between the output signal of the high pass filter and the sum output signal of the oscillators is at a minimum; and (e) subtracting the sum output signal of the oscillators from an actual value signal of position or thickness.

According to the present invention there is provided a device for compensation of the effect of roll eccentricities in position or thickness regulation of roll stands, comprising:

a multiplier for receiving as a first input the measured value of the roll force and as a second input the sum of the inverse values of the stand spring constant and the material spring constant, and for multiplying its first and second inputs together;

a mixer for adding together the measured value of the roll adjustment position and the output of the multiplier;

the high pass filter, for subtracting from the signal output from the mixer a component corresponding to a steady part of an incoming thickness value of material to be rolled by the roll stand; and a model portion comprising said oscillators, provided for simulating oscillations caused by roll eccentricities of the roll stand, a mixer for comparing the sum output signal of the oscillators with the output of the high pass filter, for producing the deviation and for supplying the deviation to the oscillators to enable adjustment of the oscillators in respect of amplitude and phase relationship in order to minimise the deviation, and an output for supplying the sum output signal of the oscillators.

An embodiment of the invention can provide a process for compensation of roll eccentricities during position or thickness regulation of roll stands, which can work both more accurately and more quickly than known processes, and which utilises measuring devices commonly present on roll stands.

An embodiment of the invention can provide a process for compensation of roll eccentricities comprising indirect actual value formation effected by determination of roll stand elasticity.

Figure 2:
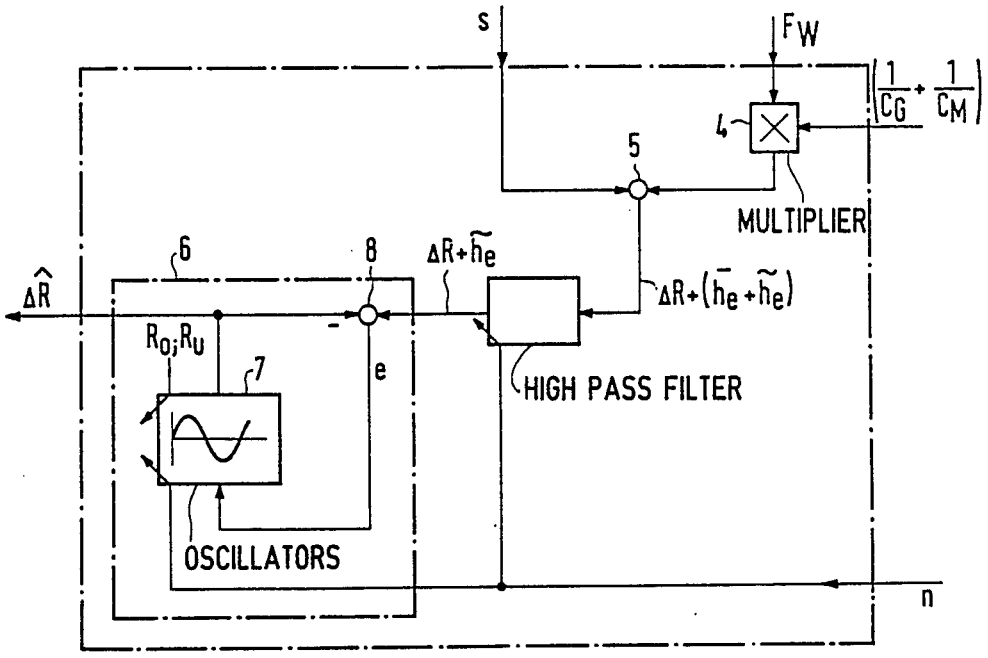
Figure 3:
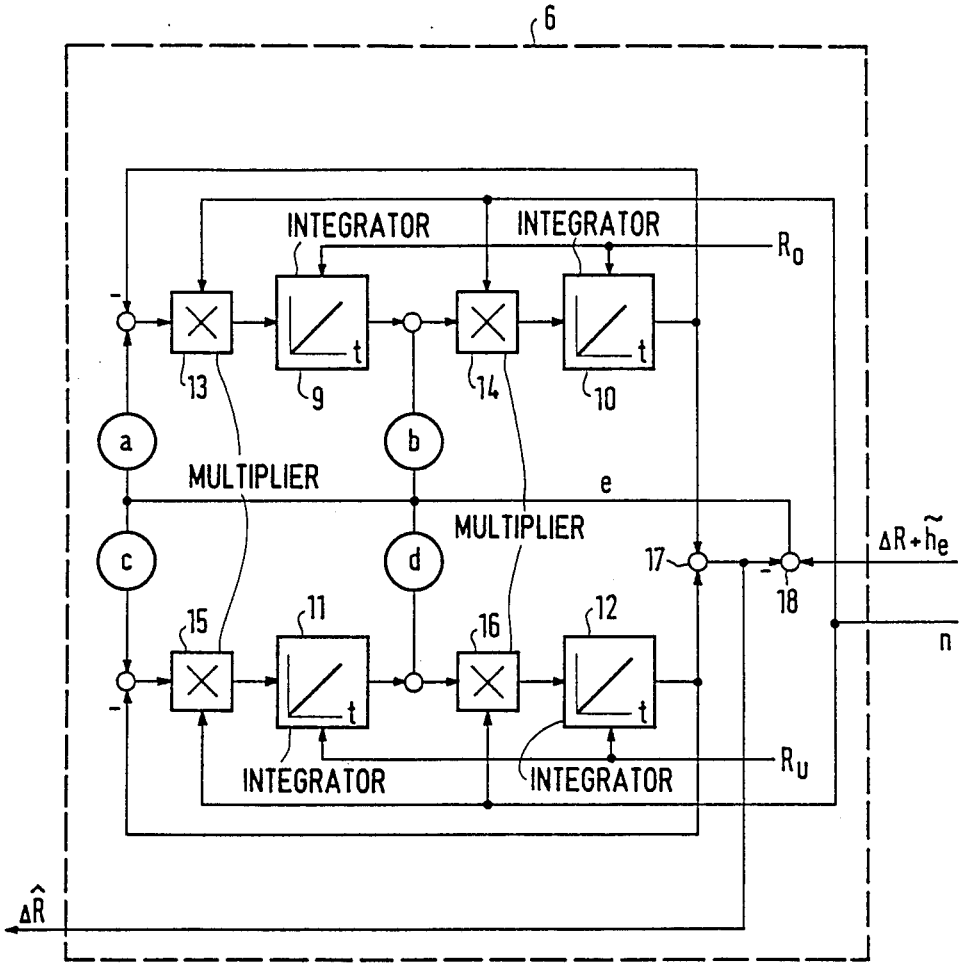
Figure 4:
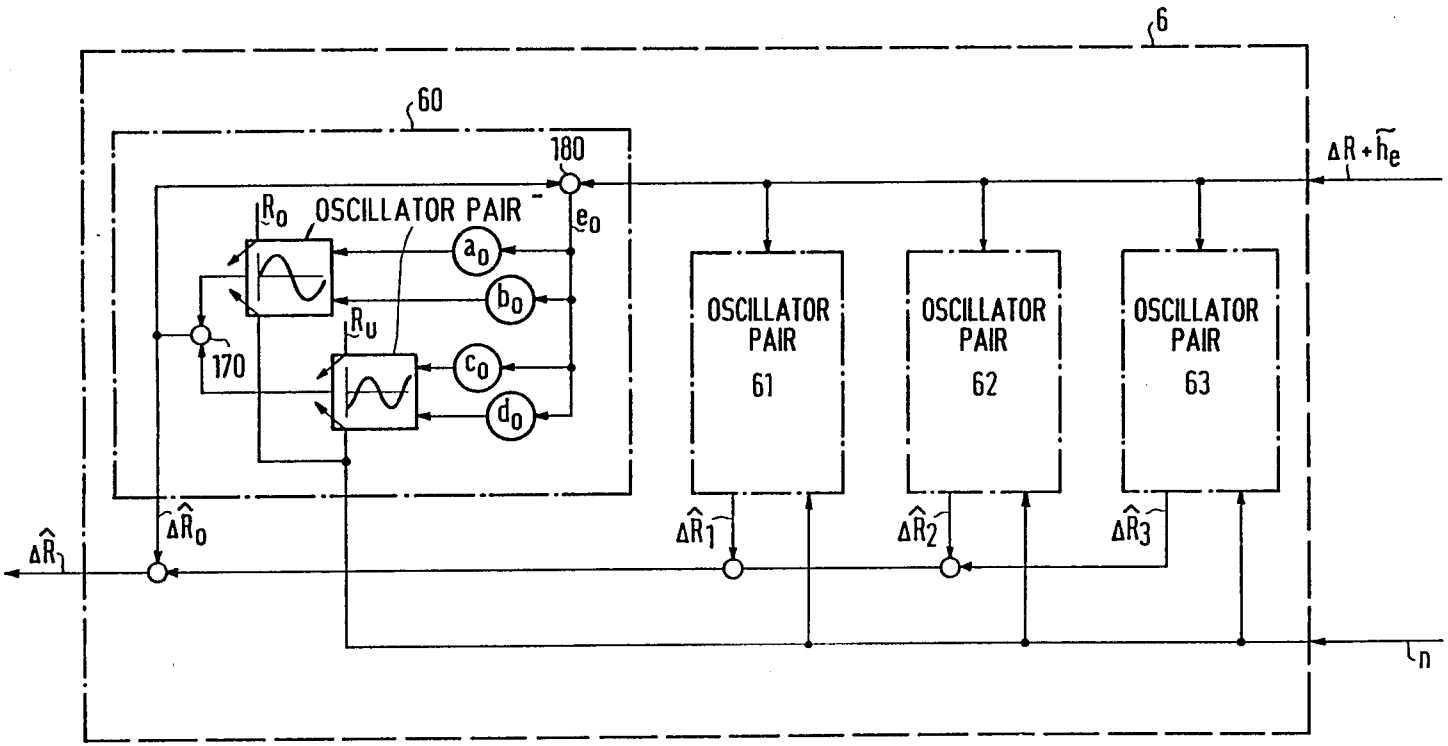
Figure 5:
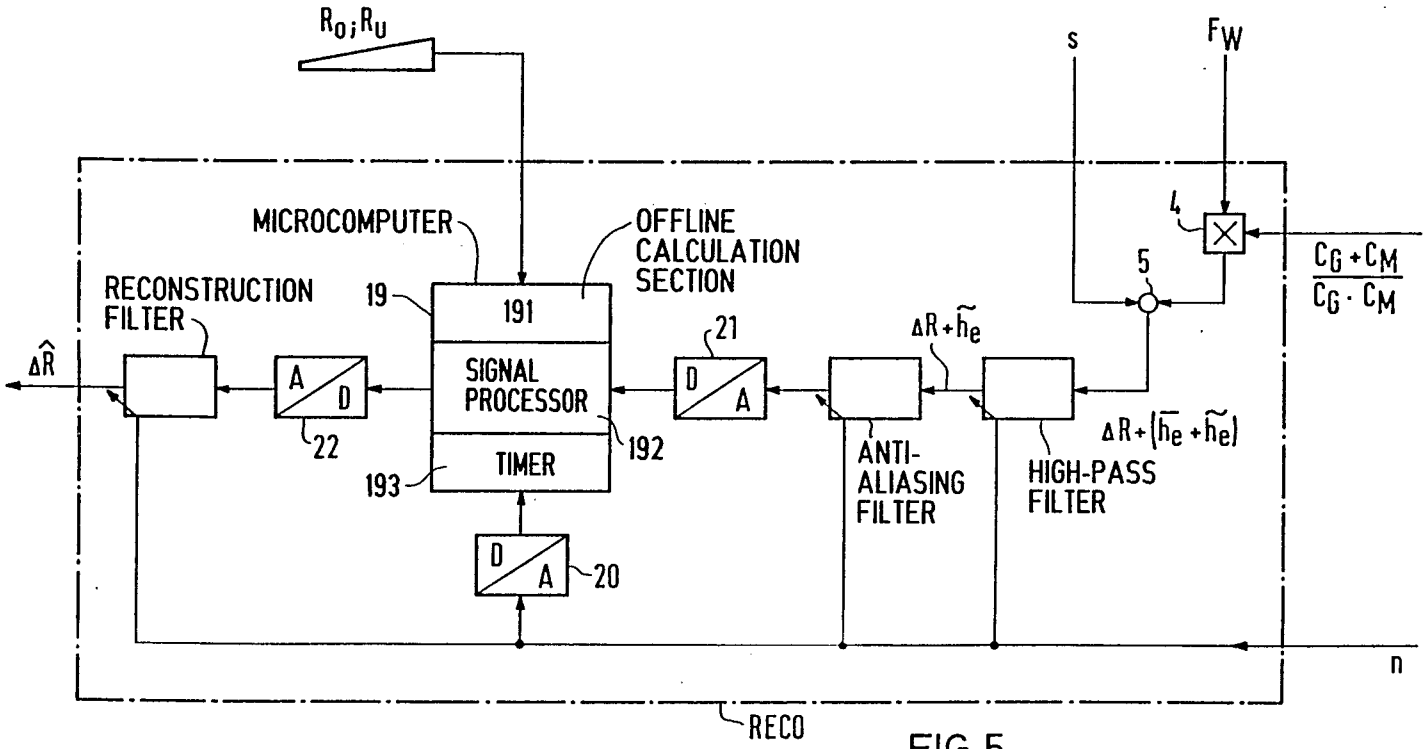

Reference is made, by way of example, to the accompanying Figures in which:

FIG. 1 schematic diagram of an arrangement comprising a roll eccentricity compensator (RECO) in accordance with an embodiment of the present invention for enabling thickness regulation of a roll stand, FIG. 2 is a schematic diagram of the basic structure of the roll eccentricity compensator of FIG. 2, FIG. 3 is a schematic diagram of an embodiment of a model for simulating a pair of roll eccentricity oscillations effected in a roll eccentricity compensator, FIG. 4 is a schematic diagram for explaining signal processing in a model with several simulated pairs of eccentricity oscillations, FIG. 5. is a schematic diagram of the construction of a roll eccentricity compensator for a process using digital signal processing.

In FIG. 1 there is schematically shown a roll stand (rolling machine) 1. The roll stand comprises an upper support roll (roller or cylinder) with radius $R_o$, a lower support roll with radius $R_u$, two worker rolls having a smaller radius than the support rolls, a hydraulic piston for providing positional adjustment of the upper support roll, and a hydraulic cylinder associated with the piston which is supported on the stand structure. The elasticity (resilience) of the stand structure is shown symbolically by a spring with a spring constant $C_G$. The material for rolling has associated with it, in a roll gap between the two worker rolls, an equivalent material spring with a spring constant $C_M$. The material is rolled by means of the two worker rolls from a run-in thickness $h_e$ down to a run-out thickness $h_a$.

Roll eccentricities of the upper or the lower support roll may arise due to uneven wear of the rolls, deformations due to heat stresses, or deviations in the geometrical cylinder axes of the rolls from the operationally adjusted axes of rotation. The roll eccentricities of the upper and lower support rolls are designated $\Delta R_o$ and $\Delta R_u$, respectively, i.e. as deviations from the ideal support roll radii $R_o$ or $R_u$.

The roll stand further comprises a number of measurement transducers; these are provided for detecting the support roll speed n (normally in the form of a tachodynamo (electric speed indicator) coupled to the drive motor), for detecting a roll force $F_w$ exerted by the hydraulic piston, and for detecting a roll adjustment position which corresponds to the relative position s of the piston in the hydraulic cylinder used for adjusting the upper support roll. In addition, 2 indicates a control element by means of which the hydraulic piston is acted on by pressure oil by means of a valve. A regulating signal for the control element is provided by an output signal of a regulator 3 whose purpose is to bring the thickness $h_a$ of the outgoing roller material into conformity with a desired thickness value $h_a$* supplied to it.

The value of the actual thickness value $h_a$ of the band (sheet, strip or layer) of rolled material is not measured directly at its origin, i.e. in the roll gap, but is determined from the roll stand elasticity and the roll adjustment position. For this purpose a device known as a gauge meter, designated GM in FIG. 1, is used. This device basically contains a multiplying device which (in a known process) multiplies the measured value of roll force $F_W$ with the inverse value of the stand spring constant $C_G$ and adds to this product the measurement value signal s of the relative hydraulic piston position. Between the input signals and the output signal of the device GM the following relationship holds:

$$h_a + \Delta R = s + F_W/C_G,$$

wherein the superimposed effects of the two support roll eccentricities $\Delta R_o$ and $\Delta R_u$ are combined within the term $\Delta R$.

The arrangement described so far corresponds substantially to a known arrangement for band thickness (rolled material thickness) regulation with determination of the actual thickness value $h_a$ being carried out according to the gauge meter principle. However, in known arrangements, in the presence of a roll eccentricity $\Delta R$ the gauge meter GM does not supply the actual thickness value $h_a$ alone but rather the sum of the band thickness and the roll eccentricity. Band thickness regulation using the gauge meter signal $(h_a + \Delta R)$ as the actual value is effective for controlling changes in the band run-in thickness into the roll stand, but acts incorrectly with regard to roll eccentricities. This is because a thickness regulation on the basis of an output signal $h_a + \Delta R$ of the gauge meter GM as an actual thickness value is carried out exactly like a thickness regulation with $h_a$ as an actual thickness value and a desired value $h_a^* - \Delta R$, so that the thickness regulation incorrectly causes the eccentricity $\Delta R$ to be rolled in to the material band with run-out thickness $h_a$, phase shifted by 180°. This is unsatisfactory because the greatest values of eccentricities can amount to several tens of micrometers, which is not compatible with present day tolerance requirements for a cold-rolled band.

Therefore, in an embodiment of the present invention, a compensation device called a RECO (roll eccentricity compensator) is used, whose purpose is to identify or simulate a roll eccentricity $\Delta R$ using measurement transducer signals s, n and $F_W$ supplied to it, and the adjustment parameters $R_o$, $R_u$, $C_G$ and $C_M$. The signal $\Delta\hat{R}$ simulated by the compensation device is used to clear up (correct) the adulterated actual value of the band run-out thickness supplied by the gauge meter GM, so that the true actual thickness value $h_a$ occurring in the roll gap can be supplied to the regulator 3. Exact compensation of the effect of the roll eccentricities $\Delta R$ can thereby be achieved. The stand spring constant $C_G$ is determined once in a test before starting rolling operation and the material spring constant $C_M$ is determined by running on-line calculation. The operation of the RECO device was based on the inventors' insight that for an exact simulation of roll eccentricities, the roll stand positional adjustment, the roll stand elasticity, and also the elastic deformation of the material during the roll process, should all be taken into account.

A compensation device in accordance with the invention can also be used with similar advantages for pure position regulation. In this case the gauge meter GM is omitted. The output signal of the compensation device RECO is subtracted from the measurement value signal s, and the result is used as an actual position value. Instead of the desired value $h_a^*$ of the run-out thickness, a desired position value is fed to the regulator 3.

FIG. 2 shows the basic construction of a roll eccentricity compensator RECO in an embodiment of the present invention.

The compensator contains a multiplier 4 to which are fed on the input side the roll force measurement signal $F_W$ and the sum of the inverse values of the stand spring constant $C_G$ and the material spring constant $C_M$. This inverse value sum corresponds to the inverse value of a spring constant resulting from the series arrangement of the elasticity of the roll stand and the elasticity of the rolled material.

The position measurement value s of the hydraulic piston adjusting the upper support roll is added to the output signal of the multiplier 4 in a mixer 5. The output signal of the mixer 5 represents the sum of the eccentricity signal $\Delta R$ caused by the eccentricities $\Delta R_o$ and $\Delta R_u$, and the band run-in thickness value $h_e$, wherein the latter consists of a direct (steady) part $\bar{h}_e$ and a statistically deviating alternating part $\tilde{h}_e$ superimposed on this. The equation $h_e = \bar{h}_e + \tilde{h}_e$ therefore applies. By means of a high pass filter HF, the steady part $\bar{h}_e$ of the run-in thickness $h_e$ is subtracted from the output signal of the mixer 5, so that at the output of the high pass filter HF, which is updated in its (angular)(cut-off) frequency by the speed measurement value n, there is produced the signal $\Delta R + \tilde{h}_e$.

From this signal, in an arrangement 6 designed according to the observer principle, a signal $\Delta\hat{R}$ is simulated which corresponds to the roll eccentricity. The arrangement 6 constitutes a back-coupled (retroactive) model for the eccentricity disturbances $\Delta R$. The arrangement 6 comprises at least two oscillators (7) for the fundamental oscillations, occurring in pairs, of the eccentricities $\Delta R_o$ and $\Delta R_u$ of the upper or the lower support roll, and in the case of pairs of relevant higher frequency oscillations (harmonics) occurring also, is suitably supplemented by appropriate further pairs of oscillators.

The frequencies of the oscillators are determined by inputs of the support roll radii $R_o$ and $R_u$ and of the mean support roll speed n. The outputs of the individual oscillators are combined to form a summation signal $\Delta\hat{R}$ and are compared with the output signal of the high pass filter HF in a mixer 8. The deviation signal e produced from this comparison is used to adjust the oscillations produced by the oscillators as regards their phase relationships and amplitudes, until the signal $\Delta\hat{R}$ is a copy of the eccentricity oscillation $\Delta R$. This is the case when the deviation e is at a minimum and corresponds only to the statistically fluctuating portion $\tilde{h}_e$ of the run-in thickness $h_e$. Frequency adaptation is thus effected continuously during rolling operations in dependence on the support roll speed n, and the (angular) (cut-off) frequency of the high pass filter HF is correspondingly entrained.

FIG. 3 shows an example embodiment of a model 6 for simulating the roll eccentricity $\Delta R$, having a pair of oscillators for the simulation of eccentricity-based oscillations.

Each oscillator is formed by a pair of integrators 9, 10 or 11, 12, wherein in each pair one integrator is arranged behind the other, and the output signal of the integrator 10 or 12 is counter-coupled to the input of integrator 9 or 11, respectively. At the input of each integrator there is arranged a multiplier 13, 14, 15 or 16, by which the frequencies of the oscillators are determined. A second input of each multiplier is acted upon by a signal n corresponding to the mean support roll speed. The components determining the time behaviour of the integrators are made to be adjustable, for example by using rotary potentiometers or variable capacitors. These components are adjusted according to the determined values of the radii $R_o$ or $R_u$ of the support rolls, and in accordance with the support roll speed n.

The outputs of the integrators 10 and 12 are added in a mixer 17, whose output signal is subtracted from the output signal $\Delta R + \tilde{h}_e$ of the high pass filter HF in a further mixer 18. The deviation e is thus obtained, by means of which the oscillations produced by the oscillators 9, 10 or 11, 12 are adjusted in respect of phase relationships and amplitudes by means of proportional elements a to d, until the summation signal $\Delta\hat{R}$ of the integrators 10 and 12 agrees with the part $\Delta R$, due to the roll eccentricity, of the input signal $(\Delta R + \tilde{h}_e)$ supplied to the disturbance model 6.

The parallel arrangement of two pairs of oscillators (integrators) shown in FIG. 3 can be converted into a functionally equivalent series connection by the use of known transformation rules. A filter of fourth order type can be recommended for many cases of usages (for the high pass filter HF).

FIG. 4 shows the structure of a disturbance model 6 in the roll eccentricity compensator RECO for a case in which three higher frequency oscillations (harmonics) are to be considered as relevant, apart from the basic (fundamental) oscillations of the roll eccentricity.

The model has four parts which are similar in construction and referenced 60, 61, 62 and 63 in FIG. 4. Each of the parts 60, 61, 62 and 63 is constructed in accordance with FIG. 3 and contains a pair of oscillators. Thus a pair of oscillators is provided for the basic oscillations and for the first, second and third harmonic oscillations respectively. The individual eccentricity simulations produced by the parts 60, 61, 62 and 63, designated $\Delta\hat{R}_o$, $\Delta\hat{R}_1$, $\Delta\hat{R}_2$ and $\Delta\hat{R}_3$ respectively, are superimposed to give a resulting simulation of the entire eccentricity $\Delta R$. Phase- and amplitude adjustment of the oscillators in each part 60, 61, 62 and 63 is effected in dependence upon individual deviations $e_o$, $e_1$, $e_2$, $e_3$. For each oscillator two adjustment amplifications (proportional elements) $a_o$, $b_o$ or $c_o$, $d_o$ are necessary, as is shown for the basic oscillation pair of the model part 60.

FIG. 5 shows the construction of a roll eccentricity compensator RECO using a digitally operating micro computer 19, in accordance with an embodiment of the present invention. In this embodiment, signal processing is effected by supplying input signals via two analog/digital converters 20 and 21 and supplying output signals via a digital/analog converter 22. The microcomputer 19 is divided into three functional blocks 191 to 193. In block 191, after input of values for the two support roll radii $R_o$ and $R_u$ and input of a nominal mean support roll speed, calculation of oscillator-frequencies to be preset takes place offline. In block 192, which contains a signal processor, signal processing for simulation of the roll eccentricity $\Delta\hat{R}$ takes place by means of oscillators in accordance with the arrangements of FIGS. 3 or 4, but converted into a functionally equivalent digital implementation. Signal processing takes place in known manner, with the values of the input signals being sampled at discrete time intervals and a simulation result being output at corresponding time intervals. A reconstruction filter RF is provided immediately after the digital-analog converter 22, so as to convert the stepped analog result sequence obtained at discrete time intervals into a time-continuous signal. Since the block 192 may be considered in practice as a digital filter, a so-called anti-aliasing filter AF is inserted after the high pass filter HF so as to avoid output signal distortion (aliasing noise) cause by sampling of input signals with frequency components too high relative to the sampling rate. Anti-aliasing filters, such as are described for example in the "2920 Analog Signal Processor Design Handbook" published by the Intel Corporation 1980, on page 2 - 1 to page 2 - 5, are low pass filters which have a high damping (attenuation), for example as much as 60 dB, at a frequency corresponding to half the sampling rate. The filters HF, AF and RF, which comprise a combination of integrators and summing amplifiers (integrating amplifiers), are as before updated in their (angular) (operating or cut-off) frequencies in dependence upon the support roll speed n. This can be achieved by means of multipliers provided at inputs of the integrators of the filters, such as in the arrangement of FIG. 3.

The block 193 contains a timer which adjusts the frequency of the oscillators in block 192, constructed by digital means, in dependence on the actual support roll speed n. The timer may, for example, be a counter that can be preset to the output value of the analog-digital converter 20. Such a counter is constantly counted down at a fixed clock rate, and outputs a pulse (for frequency adjustment) to the signal processor 192 each time a zero count is reached.

We claim:

1. A process for compensation of the effect of roll eccentricities in position or thickness regulation of a roll stand, comprising steps of:

(a) forming a sum signal from a measured value of a roll force ($F_W$) multiplied by the sum of the inverse values of a stand spring constant ($C_G$) and a material spring constant ($C_M$), and a measured value of a roll adjustment position (s);

(b) sending the sum signal through a high pass filter (HF) a frequency of which is adjusted in dependence upon a speed (n) of a support roll of the roll stand;

(c) comparing an output signal of the high pass filter with a sum output signal of at least one pair of oscillators, said oscillators being provided for simulation of roll eccentricity oscillations, and frequencies of said oscillators being preset in dependence upon the radius of the support roll and being adjusted in dependence upon the support roll speed (n);

(d) adjusting the oscillators in respect of amplitude and phase relationship so that a deviation (e) between the output signal of the high pass filter and the sum output signal of the oscillators is at a minimum; and (e) subtracting the sum output signal ($\Delta\hat{R}$) of the oscillators from an actual value signal of position or thickness.

2. A process according to claim 1, wherein for simulation of higher frequency roll eccentricity oscillations, additional pairs of oscillators are provided, sum output signals of which are also subtracted from the actual value signal.

3. A process according to claim 1, for regulation of the thickness of outgoing material rolled by the roll stand, wherein at step (e) the sum output signal ($\Delta\hat{R}$) of the oscillators is subtracted from an actual value signal ($h_a + \Delta R$) of thickness to produce a corrected actual value of thickness, and further comprising steps of:

(f) comparing the corrected actual value of thickness with a desired value of thickness ($h_a$*); and (g) supplying the result of the comparison of step (f) as input to a regulator (3) provided for controlling a control element (2), thereby to adjust the roll adjustment position (s) in order to achieve thickness regulation of the outgoing material.

4. A roll eccentricity compensator for use in the process according to any of claims 1 to 3, comprising:

a multiplier (4) for receiving as a first input the measured value of the roll force ($F_W$) and as a second input the sum of the inverse values of the stand spring constant ($C_G$) and the material spring constant ($C_M$), and for multiplying its first ($F_W$) and second inputs together;

a mixer (5) for adding together the measured value of the roll adjustment position (s) and the output of the multiplier (4);

the high pass filter (HF), for subtracting from the signal output from the mixer (5) a component corresponding to a steady part of an incoming thickness value ($h_e$) of material to be rolled by the roll stand; and a model portion (6) comprising said oscillators, provided for simulating oscillations caused by roll eccentricities of the roll stand, a mixer (8) for comparing the sum output signal of the oscillators with the output of the high pass filter (HF), for producing the deviation (e) and for supplying the deviation (e) to the oscillators to enable adjustment of the oscillators in respect of amplitude and phase relationship in order to minimise the deviation (e), and an output for supplying the sum output signal ($\Delta\hat{R}$) of the oscillators.

5. A roll eccentricity compensator for use in the process according to any of claims 1 to 3, wherein for the simulation of eccentricity oscillations there is provided a signal processor (192) operable as a digital filter, with which there is associated, via an analog-digital converter, a timer (193) which in operation is influenced by the mean support roll speed (n).

6. A roll eccentricity compensator according to claim 5, comprising: a multiplier (4) for multiplying together the measured value of the roll force ($F_W$) and a value based on the stand spring constant ($C_G$) and the material spring constant ($C_M$), a mixer (5) for adding the measured value of the roll adjustment position (s) to the output of the multiplier (4), the high pass filter (HF), for subtracting from the output of the mixer (5) a signal component corresponding to a steady part of an incoming thickness value ($h_e$) of material to be rolled by the roll stand, an anti-aliasing filter (AF), a frequency of which can be adjusted in dependence upon the support roll speed (n), for carrying out low-pass filtering of the output of the high pass filter (HF);

an analog-digital converter (21) for converting the output of the anti-aliasing filter into a digital form;

a microcomputer (19) comprising a portion (191) for calculating oscillator frequencies, the signal processor (192) for providing the at least one pair of oscillators, and the timer (193);

the analog-digital converter (20);

a digital-analog converter (22) for converting the output of the signal processor (192) into analog form;

and a reconstruction filter (RF) for smoothing the output of the digital-analog converter (22) into a timecontinuous signal.

7. A process according to claims 1, 2 or 3, wherein the roll stand is of a type which comprises an upper support roll, a worker roll in contact with the upper support roll, a lower support roll, and a worker roll in contact with the lower support roll.

* * * * *